US006593919B1

(12) United States Patent
Kishita et al.

(10) Patent No.: US 6,593,919 B1
(45) Date of Patent: Jul. 15, 2003

(54) DISPLAY PANEL DRIVING SYSTEM

(75) Inventors: Hiroyuki Kishita, Kariya (JP); Muneaki Matsumoto, Okazaki (JP); Masahiko Osada, Hekinan (JP)

(73) Assignee: Denso Corporation, Kariya (JP)

( * ) Notice: Subject to any disclaimer, the term of this patent is extended or adjusted under 35 U.S.C. 154(b) by 307 days.

(21) Appl. No.: 09/658,472

(22) Filed: Sep. 8, 2000

(30) Foreign Application Priority Data

Sep. 10, 1999 (JP) ..... 11-257358

(51) Int. Cl.[7] ..... G09G 5/00

(52) U.S. Cl. ..... 345/204; 345/87; 345/77; 345/78; 345/79; 345/80; 345/81; 345/82; 345/690; 345/691

(58) Field of Search ..... 345/204, 211, 345/213, 690, 691, 77, 78, 79, 80, 81, 82, 87; 315/169.3, 169.1; 340/767

(56) References Cited

U.S. PATENT DOCUMENTS 400,237 A * 3/1889 Martane ..... 363/37
4,897,639 A * 1/1990 Kanayama ..... 315/169.3
4,951,041 A 8/1990 Inada et al.
5,847,516 A 12/1998 Kishita et al.

FOREIGN PATENT DOCUMENTS

JP B2-2797185 7/1998

* cited by examiner

*Primary Examiner*—Richard Hjerpe
*Assistant Examiner*—Ali Zamani
(74) *Attorney, Agent, or Firm*—Posz & Bethards, PLC

(57) ABSTRACT

A display panel driving system, constituted in such a manner that the occurrence of a display irregularity on the display panel can be suppressed without regard to the characteristics or the driving condition of the display panel, is disclosed. An up-counter counts the number of the picture elements which emit light when the EL display panel is horizontally scanned, and the counting result thus obtained is outputted as an addressing signal to an EEPROM. Stored in the EEPROM are data maps MAP, MAP in which pulse width data are written at a plurality of addresses corresponding to the counting ranges of the up-counter. A signal generation means outputs a blank signal BLK which determines the pulse width of a data voltage on the basis of the pulse width data addressed by the up-counter.

19 Claims, 8 Drawing Sheets

BLK
15
18b
18
18a
S
Q
R
17
CLOCK GENERATION (T=2μS)
12
CK
R
L
D
CK
Q
16
13
A8
A7
A0
D11
D0
DATA SIGNAL
HS SIGNAL
ODD TRIP SIGNAL
MAP1
ADD
PW
001h 004h (6μS)
002h 004h (6μS)
003h 008h (8μS)
004h 008h (8μS)
005h 008h (8μS)
006h 010h (10μS)
MAP2
ADD
PW
101h 008h (8μS)
102h 008h (8μS)
103h 010h (10μS)
104h 010h (10μS)
105h 010h (10μS)
106h 020h (12μS)

8
12
CK
R
DATA SIGNAL
HS SIGNAL
+Vcc
14a
14
19
BLK
18b
18
18a
S
Q
R
L
D
CK
20
17'
CLOCK GENERATION (T=0.2μS)
Pc'
13
MAP1
ADD
PW
001h 0Ch (6μS)
002h 0Ch (6μS)
003h 10h (8μS)
004h 10h (8μS)
005h 10h (8μS)
006h 14h (10μS)
MAP2
ADD
PW
101h 08h (4μS)
102h 08h (4μS)
103h 0Ch (6μS)
104h 0Ch (6μS)
105h 10h (8μS)
106h 10h (8μS)

FIG. 9

13

MAP1

| ADD | COUNT | PW |
|---|---|---|
| 001h | 02h (1~2 DOT) | 004h (6μS) |
| 002h | 05h (3~5 DOT) | 008h (8μS) |
| 003h | 09h (6~9 DOT) | 010h (10μS) |
| 004h | 10h (10~16 DOT) | 020h (12μS) |
| 005h | 19h (17~25 DOT) | 040h (14μS) |
| ⋮ | ⋮ | |

MAP2

| ADD | COUNT | PW |
|---|---|---|
| 101h | 02h (1~2 DOT) | 001h (4μS) |
| 102h | 04h (3~4 DOT) | 004h (6μS) |
| 103h | 08h (5~8 DOT) | 008h (8μS) |
| 104h | 0Eh (9~14 DOT) | 010h (10μS) |
| 105h | 16h (15~22 DOT) | 020h (12μS) |
| ⋮ | ⋮ | |

DISPLAY PANEL DRIVING SYSTEM

CROSS REFERENCE TO RELATED APPLICATION

This application is based upon Japanese Patent Application No. Hei. 11-257358 filed on Sep. 10, 1999, the contents of which are incorporated herein by reference.

BACKGROUND OF THE INVENTION

1. Field of the Invention

The present invention relates to a display panel driving system which has scanning electrodes and data electrodes and is driven by a sequential scanning method.

2. Related Art

As an example of an EL (Electro Luminescence) display panel for example, there is proposed a display panel comprising a structure constituted in such a manner that, on both sides of a light-emitting layer (EL layer), a plurality of scanning electrodes and a plurality of data electrodes are matrix-wise arranged, and the display picture elements formed at the positions at which the respective electrodes cross each other are made to emit light by line-sequential scanning. Such a display panel has the characteristic that, in proportion to the increase in number of the light-emitting picture elements on one and the same scanning electrode, the bluntness of the voltage waveform applied through the respective electrodes is enlarged. Due to this, there is caused the phenomenon (the so-called shadowing phenomenon) that the brightness of the picture elements which emit light during each scanning period comes to vary in accordance with the number of the light-emitting picture elements, as a result of which a brightness irregularity, (display unevenness) is caused, thus deteriorating the display quality. This is a problematic point.

In order to cope with such a problematic point, a technique as disclosed in Japanese Patent Publication No. 48137/1995 or the specification of Japanese Patent No. 2797185 has so far been proposed. According to this technique, in order to suppress the shadowing phenomenon, correction control is executed in such a manner that the light-emitting picture element number corresponding to one scanning period is counted by the use of a capacitor or digital type counter, and, on the basis of the counting result thus obtained, the pulse width of the scanning voltage applied to the scanning electrodes is changed.

In case of the above-mentioned known technique, the relationship between the light-emitting picture element number corresponding to one scanning period and the pulse width of the scanning voltage at the time of correction control is a linear proportional relationship. However, due to the fact that, in case of the EL display panel, the relationship between the light-emitting picture element number and the brightness varies in accordance with a change in the picture element arrangement (the scanning electrode number and the data electrode number), the picture element capacitance, etc., it becomes necessary to sequentially adjust the relationship between the light-emitting picture element number corresponding to one scanning period and the pulse width of the scanning voltage. Due to this, in case that the relationship between the light-emitting picture elements corresponding to one scanning period and the pulse width of the scanning voltage can be controlled only as a linear proportional relationship as according to the known technique, there is encountered the problem that, in case of some kind of display panel, it turns out to be difficult to suppress the occurrence of the shadowing phenomenon (that is, the occurrence of brightness irregularity). Further, there is the characteristic that, even in case of one and the same display panel, the relationship between the light-emitting picture element number and the brightness does not become a linear proportional relationship in case that the driving condition (such as, e.g., the pulse width of the scanning voltage) is changed. Due to this, in case of the known technique, it becomes difficult to accurately suppress the occurrence of the shadowing phenomenon, depending on the driving condition.

SUMMARY OF THE INVENTION

The present invention has been made in order to give a solution to the above-mentioned problem, and it is the object of the invention to provide a display panel driving system which can achieve effects such as the effect that the occurrence of a display irregularity on the display panel can be accurately suppressed without regard of the characteristic of the display panel and the driving condition.

According to the first aspect of the present invention, a control circuit applies the composite voltage consisting of a scanning voltage and a data voltage to the display panel by a sequential scanning method to thereby turn into a display state the display elements formed in the regions in which scanning electrodes and data electrodes are opposed to each other. At this point of time, in the control circuit, a counter means comes to count the number of those display elements which are brought into a display state in response to the application of a voltage corresponding to one scan, and, by the counting result thus obtained, an address of data maps in a memory means is designated. Further, a signal generation means comes to generate a control signal for controlling the application time of the above-mentioned composite voltage so as to assume a state associated with the pulse width data or voltage value data corresponding to the designated address.

Into the above-mentioned data maps, a plurality of addresses corresponding to the counting ranges of the counter means and a plurality of stages of pulse width data indicating the pulse width of the composite voltage or a plurality of stages of voltage value data indicative of the magnitude of the composite voltage are previously written in the state in which they are associated with each other; and therefore, it becomes possible to execute the correction control of changing the application time or the magnitude of the composite voltage (that is, the display state of the display elements) on the basis of the counting result (in other words, the number of those display elements which are brought into a display state in response to one scan) of the counter means. Thus, the occurrence of a shadowing phenomenon can be suppressed. In this case, the relationship of correspondence between the addresses in the data maps and the pulse width data or the relationship of correspondence between the above-mentioned addresses and the voltage value data come to be settable into an optimum state corresponding to the characteristic and the driving condition of the display panel which is the object to be driven. More specifically, in case of the known technique, the relationship between the number of those display elements which are brought into a display state during one scanning period and the application time of the composite voltage can be controlled only as a linear proportional relationship, whereas, according to the present invention, the relationship between the above-mentioned display element number and the application time or magnitude of the composite voltage can be controlled in to an arbitrary state. Accordingly, the application time or magnitude of the composite voltage controlled by the control signal outputted from the signal generation means can be controlled into an optimum state taking into consideration the characteristic and the driving condition of the display panel, so that the occurrence of a display irregularity on the display panel can be accurately suppressed without regard to the characteristic and driving condition of the display panel.

In the second aspect of the present invention, likewise, the display elements are turned into a display state by the control circuit in response to applying to the display panel the composite voltage by the sequential scanning method, the above-mentioned composite voltage consisting of the scanning voltage and the data voltage. At this point of time, in the control circuit, the counter means comes to count the number of those display elements which are brought into a display state in response to the application of a voltage corresponding to one scan, and, by the ensuing counting result, an address in the data maps in the memory means is designated. Further, a shift register converts the pulse width data or the voltage value data corresponding to the designated address into a serial signal train synchronized with a clock signal and, at the same time, a signal processing circuit produces a control signal, on the basis of the output from the shift register, for controlling the application time or magnitude of the composite voltage so as to assume a state corresponding to the above-mentioned read pulse width data or voltage value data.

In the above-mentioned data maps, data similar to the data in case of the first aspect of the invention are written. Accordingly, in this second aspect of the invention, likewise, the correction control of changing the application time of the composite voltage on the basis of the counting result of the counter means can be executed, so that the occurrence of a shadowing phenomenon can be suppressed. Further, the application time or magnitude of composite voltage controlled by the control signal from the signal processing circuit can be controlled into an optimum state with the characteristic and driving condition of the display panel taken into consideration, and thus, the occurrence of a display irregularity on the display panel can be accurately suppressed without regard to the characteristic or the driving condition of the display panel.

BRIEF DESCRIPTION OF THE DRAWINGS

These and another objects, features and characteristics of the present invention will be appreciated from a study of the following detailed description, the appended claims, and drawings, all of which form parts of this application. In the drawings, same portions or corresponding portions are put the same numerals each other to eliminate redundant explanation. In the drawings:

FIG. 9 is diagram showing the contents of the data maps according to a fifth embodiment of the invention.

DESCRIPTION OF THE PREFERRED EMBODIMENTS (First Embodiment)

FIG. 1 to FIG. 4 show a first embodiment of the invention in which the invention is applied to the driving system for driving an EL display panel; this first embodiment will be described below.

Figure 3:
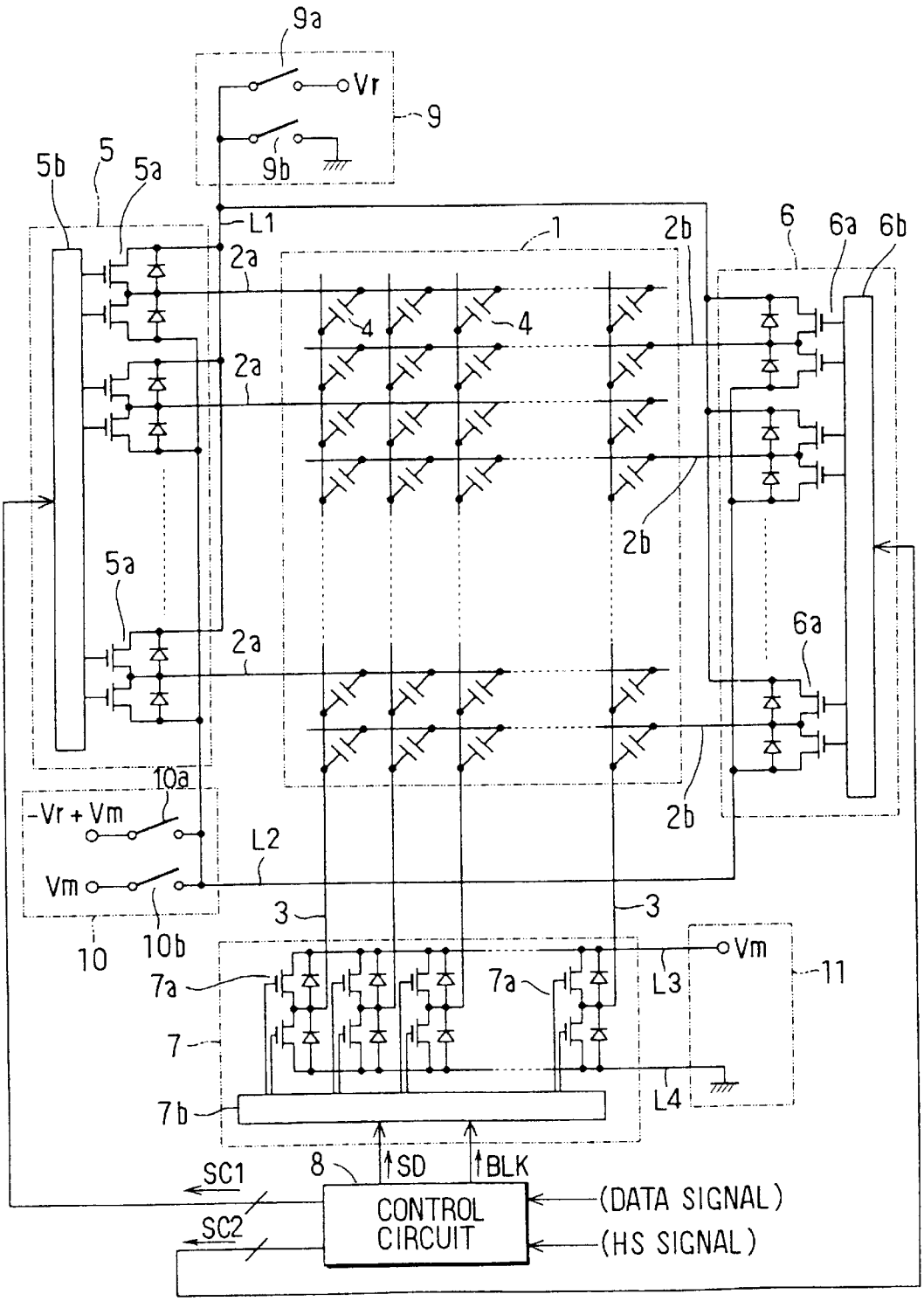
FIG. 3 is a diagram schematically showing the whole electrical arrangement.
Figure 4:
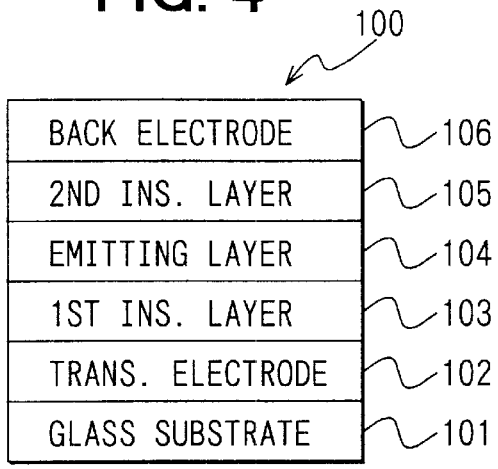
FIG. 4 is a diagram symbolically showing the basic sectional structure of the EL element.

FIG. 3 schematically shows the whole electrical arrangement including the EL display panel, and FIG. 4 symbolically shows the basic sectional structure of the EL element which constitutes the EL display panel.

First, referring to FIG. 4, an EL element 100 is constituted in such a manner that a transparent electrode 102, a first insulating layer 103, a light-emitting layer 104 (display layer), a second insulating layer 105, and a back electrode 106 are stacked on a glass substrate 101 in this order; and, when an AC driving voltage pulse is applied across the transparent electrode 102 and the back electrode 106, the optical characteristic of the light-emitting layer 104 is changed to emit light. In case that of FIG. 4, the optical output is led out from the transparent electrode 102 side, but, if the back electrode 106 is comprised of a transparent electrode, then optical outputs can be obtained from both sides.

Referring to FIG. 3, an EL display panel 1 is constituted in such a manner that the EL display element 100 of the structure shown in FIG. 4 is formed into a passive matrix type, wherein a plurality of odd-numbered scanning electrodes 2*a* and a plurality of even-numbered scanning electrodes 2*b* (These electrodes 2*a* and 2*b* respectively correspond to the transparent electrode 102 shown in FIG. 4) and a plurality of data electrodes 3 (correspond to the back electrode 106 shown in FIG. 4) are disposed so as to intersect each other. In the respective regions in which the above-mentioned scanning electrodes 2*a*, 2*b* and the data electrodes 3 intersect each other, picture elements 4 (corresponding to what are called display elements in the present invention) comprising EL elements are formed, respectively. In this case, the picture elements 4 are capacitive display elements and thus shown by the use of the symbol standing for capacitors.

In order to display-drive the above-mentioned EL display panel 1, there are provided scanning side drivers IC 5 and 6 (corresponding to the scanning electrode driving circuits) made in the form of an IC chip and a data side driver IC7 (corresponding to the data electrode driving circuit).

The scanning-side driver IC5 is comprised of a plurality of push-pull driving circuits 5*a* which are connected to the respective odd-numbered scanning electrodes 2*a* and a driver 5*b* for controlling the operation of these push-pull driving circuits 5*a*, wherein a pulsed scanning voltage can be applied to the respective odd-numbered scanning electrodes 2*a* at a timing corresponding to a scanning command signal SC1 from a control circuit 8 which will be descried later.

The scanning-side driver IC6, which has a similar constitution, comprises a plurality of push-pull driving circuits 6*a* connected to the respective even-numbered scanning electrodes 2*b* and a driver 6*b* for controlling the operation of these push-pull driving circuits 6*a*; and, to the respective even-numbered scanning electrodes 2*b*, a pulsed scanning voltage is applied at a timing corresponding to a scanning command signal SC2 from the control circuit 8.

A data-side driver IC7 comprises s plurality of push-pull driving circuit 7*a* which are connected to the respective data electrodes 3, respectively, and a driver 7*b* for controlling the operation of these push-pull driving circuits 7*a*, wherein, to the respective data 3, a pulsed data voltage is applied at a timing corresponding to an operation command signal SD from the control circuit 8.

The respective push-pull driving circuits 5*a*, 6*a* and 7*a* in the scanning-side drivers C5, C6 and the data-side driver IC7 are comprised of P-channel FETs and N-channel FETs in case of the embodiment shown in FIG. 3, wherein the parasitic diodes formed between the sources and drains of the respective FETs are also shown.

To the scanning-side drivers IC5 and IC6, scanning voltage feed circuits 9 and 10 for feeding the scanning voltage are incidentally provided. Of the two scanning voltage feed circuits 9, 10, the scanning voltage feed circuit 9 has switching elements 9*a*, 9*b* and feeds a DC voltage (write voltage) Vr or an earth voltage, in response to the ON or OFF state of the switching elements, to a source-side common connection line L1 of the P-channel FETs in the respective push-pull driving circuits 5*a*, 6*a* of the scanning-side drivers IC5, IC6. The other scanning voltage feed circuit 10 has switching elements 10*a*, 10*b* so as to feeds a DC voltage, −Vr+Vm, or a DC voltage (modulation voltage) Vm for offset to a source-side common connection line L2 of the N-channel FETs in the respective push-pull driving circuits 5*a*, 6*a* of the scanning-side drivers IC5 and IC6.

Further, to the data-side driver IC7, a data voltage feed circuit 11 for feeding a data voltage is provided incidentally. This data voltage feed circuit 11 feeds a DC voltage (modulation voltage) Vm to a source-side common connection line L3 of the P-channel FETs in the push-pull driving circuits 7*a* in the data-side driver IC7 and also feeds an earth voltage to a source-side common connection line L4 of the N-channel FETs in the push-pull driving circuits 7*a*.

In the constitution described above, in order to make the picture elements 4 emit light, it is necessary to apply an AC-like pulse voltage between the scanning electrodes 2*a*, 2*b* and the data electrodes 3, due to which the driving structure is constituted in such a manner that a pulse voltage which inverts its polarity to the positive or the negative polarity from field to field is formed at every scanning period to carry out the driving. Such a driving method is disclosed in detail in, e.g., Japanese Patent No. 2,914,234 specification, and therefore, the description concerning such a driving method is omitted here.

Here, the control circuit 8 converts the data signal given as a serial signal from an EL controller (not shown), into a parallel signal by means of a shift register (not shown) or the like to form, the above-mentioned operation command signal SD and, further, forms the above-mentioned scanning command signals SC1, SC2 for sequentially scanning the scanning electrodes 2*a*, 2*b* by means of a shift register and a timing circuit (Neither of them is shown in the drawings) with the horizontal scanning signal from the above-mentioned EL controller. These command signals SC1, SC2 and SD are then applied to the scanning-side drivers IC5, IC6 and the data-side driver IC7, whereby the composite voltage consisting of the above-mentioned scanning voltage (In actuality, the DC voltage Vr (the positive field period), the DC voltage −Vr+Vm (the negative filed period)) and the data Voltage (In actually, the earth Voltage (the positive field period) the DC voltage Vm (the negative field period)) is applied to the EL display panel 1 by the line-sequential scanning method, so that those picture elements 4 at which the thus applied composite voltage have become higher than the threshold voltage (Vr>the threshold voltage>(Vr−Vm)) are selectively turned into a light-emitting state (display state).

In this case, particularly the data-side driver IC7 is arranged so as to receive a blank signal BLK (corresponding to what is called control signal in the present invention) outputted from the control circuit 8 as will be described later. This blank signal BLK is a low-level signal which determines the pulse width of the data voltage applied to the respective data electrodes 3, in other words, the application time of the composite voltage higher than the above-mentioned threshold voltage value; this data-side driver IC7 is constituted so as to feed, only the outputting period of the blank signal BLK, the data electrodes 3 with the data voltage (the earth voltage (the positive field period) or the DC voltage Vm (the negative field period)) which is necessary to make the picture elements 4 emit light in synchronism with the application of the scanning voltage. Accordingly, the brightness of the light emitted by the picture elements 4 can be adjusted depending on the length of the blank signal BLK (the low-level signal).

Figure 1:
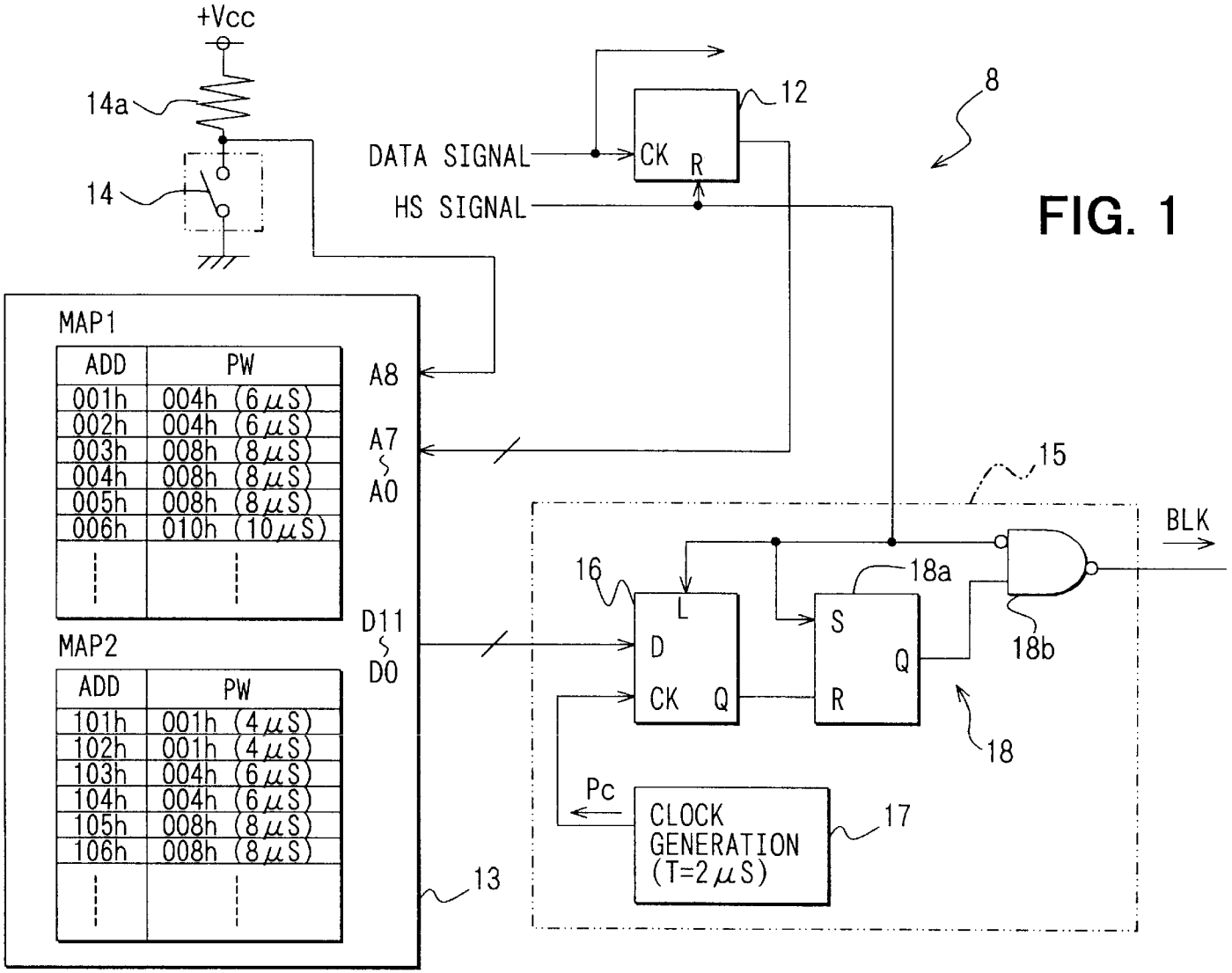
FIG. 1 is a diagram showing the electrical arrangement of the essential portion of a first embodiment of the present invention.

Now, FIG. 1 shows the constitution of only that portion of the inner constitution of the control circuit 8 which is concerned with the gist of the present invention; and the above-mentioned constitutional portion will be described below.

The data signal (serial signal) from the above-mentioned EL controller (not shown) is outputted in synchronism with the horizontal synchronizing signal (See FIG. 2) for performing the line-sequential scan of the EL display panel 1, is applied to the above-mentioned shift register (not shown) for the data signal, and also applied to a clock terminal CK of an up-counter 12 (corresponding to the counter means). The up-counter 12 is arranged in such a manner that the horizontal synchronizing signal is inputted to a reset terminal R of the up-counter 12, whereby the up-counter 12 comes to count the number (the number of the picture elements 4 which are brought into a light-emitting state when the composite voltage corresponding to one horizontal scan (one line) is applied to the EL display panel 1) of the light-emitting picture elements data contained in a pulse-like form in the data signal inputted during each cyclic period of the horizontal synchronizing signal. In case of this embodiment, the count value of the up-counter 12 is outputted as, e.g., 8-bit data; and therefore, the number of the data electrodes 3 is allowed to reach "255".

The count output from the up-counter 12 is given as an addressing signal to the address terminals A0 to A7 of an EEPROM 13 (corresponding to the memory means) which is a data-rewritable non-volatile memory. In this EEPROM 13, there are stored for example two kinds of data maps MAP 1, MAP 2 in which a plurality stages of pulse width data are written in a manner corresponding to the respective addresses at the rate of one to one, and the pulse width data addressed by the count output from the up-counter 12 is outputted from data terminals D0 to D11. The above-mentioned pulse width data indicates the application time (pulse width) of the composite voltage which is to be applied to the picture elements 4 and is higher than the above-mentioned threshold voltage; and, in the data maps MAP 1, MAP 2 stored in the EEPROM 13, examples of the actual application time are shown in a state written in parentheses and in a manner made to correspond to the respective pulse width data.

Here, in the respective data maps MAP 1, MAP 12 shown in FIG. 1, the addresses and the pulse width data are expressed by the use of sexadecimal numbers for convenience' sake; in particular, the pulse width data are constituted as 12 monopulse-shaped bit data set in such a manner that only a predetermined one bit becomes "1", while the other bits become "0". More specifically, for example, the pulse width data of "004h" is the data of the bit train, "000000000100", and the pulse width data "010h" is a bit train data, "000000010000". Therefore, the pulse width data written in the data maps MAP 1, MAP 2 become 12 kinds at the most.

Further, to the address terminal A8 of the EEPROM 13, a high-order address designating signal for selecting one of the data maps MAP 1, MAP 2 is inputted. In this case, as the means of producing the high-order address-designating signal, for example a DIP switch 14 (corresponding to the external switch) is provided. One end of this DIP switch 14 is connected to a power supply terminal, +Vcc, through a pull-up resistor 14*a*, while the other end of the DIP switch 14 is connected to a ground terminal, and, in response to the ON or OFF state of the DIP switch 14, the high-order address designating signal with a logic value of "0" or "1" is produced. Further, the switching setting of this DIP switch 14 is made, for example, on the manufacturing line or at the time of maintenance operation after the product is shipped; when the DIP switch 14 is in ON state, the data map MAP 1 is selected, while, when the DIP switch 14 is ON state, the data MAP 1 is selected, while, when the DIP switch 14 is in OFF state, the data MAP 2 is selected.

The pulse width data thus addressed in the EEPROM 13 is given to a data terminal D of a parallel input-series output shift register 16 having the signal generating means 15. This shift register 16 is arranged so as to receive at its clock terminal CK the clock pulse Pc (with a cyclic period T of, e.g., 2 $\mu$S) from a clock generation 17 and, at the same time, receives the above-mentioned horizontal synchronizing signal at its control terminal L; and, when this horizontal synchronizing signal has risen, the shift register 16 converts the pulse width data from the EEPROM 13 into a pulse width data of a serial signal train synchronized with the clock pulse Pc and outputs this converted data from an output terminal Q.

The output from the shift register 16 is fed to a reset terminal R of an R-S flip-flop 18*a* in a signal processing circuit 18. This signal processing circuit 18 is comprised of the flip-flop circuit 18*a* and a NAND circuit 18*b*, of which one of the inputs is made to be a negative logic input, and the signal processing circuit 18 receives the above-mentioned horizontal synchronizing signal at the input terminal S of the flip-flop 18*a* and at the negative logic input terminal of the NAND circuit 18*b*. Further, the output terminal Q of the flip-flop 18*b* is connected to the positive logic input terminal of the NAND circuit 18*b*, and, from this NAND circuit 18*b*, the above-mentioned blank signal BLK is outputted.

Next, the operation of the constitution described above will be described, referring also to the timing chart shown in FIG. 2.

The up-counter 12 is reset at every timing (shown by t1 in FIG. 2) when the horizontal synchronizing signal rises, thus coming to count from the initial state the number of the light-emitting picture elements contained in the data signal, and the count value thus obtained turns out to indicate the number of the picture elements 4 which are brought into a light-emitting state when the composite voltage corresponding to one horizontal scan is applied to the EL display panel 1. In response to this, from that one of the data maps MAP 1, MAP 2 which is already selected by the DIP switch 14, the pulse width data addressed by the above-mentioned count value is read out and outputted.

Figure 2:
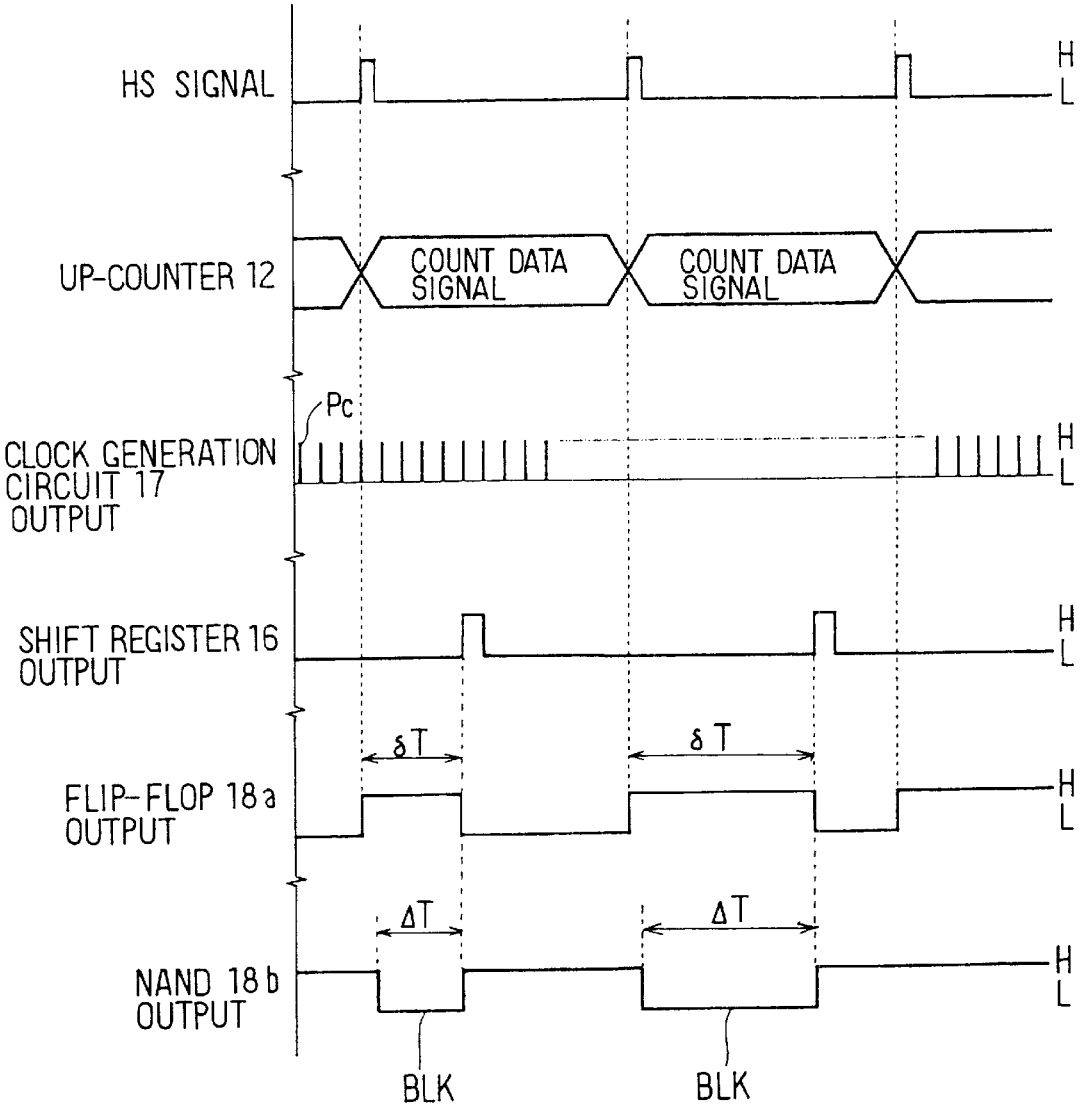
FIG. 2 is a timing chart used for explanation of the operation.

The pulse width data thus outputted is taken into the shift register 16 thereafter at the timing when the horizontal synchronizing signal rises, whereby the pulse width data is converted into the pulse width data of a serial signal train (See FIG. 2(*d*)). More specifically, in case that, for example, the pulse width data "010h" corresponding to the address "006h" in the data map MAP 1 is read out, the above-mentioned pulse width data is converted into a pulse width data in the form of the serial bit train "1000000010000".

On the other hand, the R-S flip-flop 18*a* is set in synchronism with the rise timing t1 of the horizontal synchronizing signal and comes to output a high-level signal from the output terminal Q, but the R-S flip-flop 18*a* is reset at the timing (shown by t2 and t3 in FIG. 2) at which the pulse width data from the shift register 16 rises and thus comes to-output a low-level signal from the output terminal Q. In this case, the time $\delta$T during which the output from the R-S flip-flop 18*a* is inverted into a high-level signal is determined depending on the kind of the pulse width data outputted from the shift register 16 and the cyclic period T (=2 $\mu$S) of the clock pulse Pc.

More specifically, in case that, for example, the pulse width data is "1000000010000", the flip-flop 18*a* is reset at the timing when the clock pulse Pc is outputted five times after the rise of the horizontal synchronizing signal, so that $\delta$T=10 $\mu$S, and, in case that the pulse width data is "000000000100", the flip-flop 18*a* is reset at the timing when the clock pulse Pc is outputted three times after the rise of the horizontal synchronizing signal, so thus, it follows that $\delta$T=6 $\mu$S.

In the NAND circuit 18*b* which receives the output of the R-S flip-flop 18*a* at its positive logic input terminal, the horizontal synchronizing signal is inputted to its negative logic input terminal, so that, as shown in FIG. 2(*f*), only during the period $\Delta$T during which the horizontal synchronizing signal is in low-level state and the output from the flip-flop 18*a* is inverted to a high-level signal, the NAND circuit 18*b* comes to output the blank signal BLK at a low level. As mentioned above, the luminous brightness of the picture elements 4 is adjusted by the length of the outputting period of this blank signal BLK.

According to the above-described embodiment, the control circuit 8 applies the composite voltage consisting of the scanning voltage and the data voltage to the EL display panel by the line-sequential method, whereby the picture elements 4 formed in the regions in which the scanning electrodes 2*a*, 2*b* and the data electrode 3 intersect each other are selectively switched into a light-emitting state. In this case, the up-counter 12 counts the number of those picture elements 4 which are brought into a light-emitting state in response to the application of the composite voltage corresponding to one scan, and, by the result of the above-mentioned counting, an address in the data maps MAP 1, MAP 2 in the EEPROM 13 is designated. Further, the shift register 16 converts the pulse width data corresponding to the designated address, into a serial signal train synchronized with the clock signal Pc, and at the same time, the signal processing circuit 17 produces the blank signal BLK on the basis of the output from the shift register 16. This blank signal BLK is applied to the data-side driver IC7, whereby the application time (that is, the luminous brightness of the picture elements 4) of the composite voltage which is higher than the above-mentioned threshold value is brought into a state corresponding to the pulse width data associated with the designated address.

Here, the data maps MAP 1, MAP 2 are stored in the state in which a plurality of addresses corresponding to the count range of the up-counter 12 and a plurality of stages of pulse width data are previously associated with each other. Therefore, by suitably setting the memory pulse width data, it becomes possible to execute the correction control of changing the application time (the luminous brightness of the picture elements 4 of the composite voltage that is higher than the above-mentioned threshold voltage value on the basis of the counting result of the up-counter 12 (that is, the number of the picture elements 4 which are brought into a light-emitting state in response to one scan). As a result, it becomes possible to suppress the occurrence of the shadowing phenomenon that, from scanning period to scanning period, the brightness of the light-emitting picture elements 4 varies in accordance with the number of the light-emitting picture elements 4.

In short, the relationship of correspondence between the addresses and the pulse width data in the data maps MAP 1, MAP 2 can be set to an optimum state corresponding to the characteristic and the driving condition of the EL display panel, which is the object to be driven. In other words, in case of the known technique, control can be only by a linear proportional relationship between the number the picture elements which are brought into a display state and the application time of the composite voltage higher than the threshold voltage, whereas, in case of the constitution using data maps MAP 1, MAP 2 as according to this embodiment, the relationship between the number of the light-emitting picture elements 4 and the application time of the composite voltage higher than the threshold voltage can be controlled into an arbitrary state. Therefore, the application time of the composite voltage, higher than the threshold voltage, which is controlled by the above-mentioned blank signal BLK, can be controlled to an optimum state taking into consideration the characteristic and the driving condition of the EL display panel 1, as result of which the occurrence of a display irregularity (brightness unevenness) can be accurately suppressed without regard to the characteristic and the driving condition of the EL display panel 1.

Further, it is in the state in which the ratio between the highest brightness portion and the lowest brightness portion becomes 1:0.7 or below that it becomes possible for the ordinary user to recognize the display irregularity, and therefore, the pulse width data written into the data maps MAP 1, MAP 2 may be determined by taking such a condition into consideration. Further, in this embodiment, the whole of the control circuit 8 is constituted by a digital circuit, so that the deterioration with time does not occur unlike in case that the whole constitution is comprised by an analog circuit; and thus, the present invention has the merit that there is no fear that the characteristic of the correction control with respect to the above-mentioned shadowing phenomenon may be changed.

Further, in view of the mass production of the EL display panels, it cannot be avoided, generally, that the capacitance of the picture elements be varied from product to product, due to the dispersion in film thickness which is caused at the time of forming the first insulating layer 103, the light-emitting layer 104, and the second insulating layer 105 (See FIG. 4). Therefore, it is desirable to change the contents of the above-mentioned correction control for each of the respective individual EL display panels 1, whereby the characteristic dispersion can be eliminated. However, in case of the known technique as disclosed in, e.g., Japanese Patent Publication No. 48137/1995 or the specification of Patent No. 2797185, the correction control f or suppressing the shadowing phenomenon is comprised of a hardware constitution according to which the correction control is unambiguously executed on the basis of the light-emitting picture element number corresponding to one scan; and therefore, it is perfectly impossible to absorb the characteristic dispersion of the EL display panel, and the display quality is deteriorated in some cases, this being a defect.

In contrast, according to the present invention, in the EEPROM 13, there are stored two kinds of data maps MAP 1, MAP 2 which differ from each other in respect of the relationship of correspondence between the respective addresses and the pulse width data, and there is disposed the DIP switch 14 for selecting one from among the data maps MAP 1, MAP 2. Due to this, in response to the manipulation of the DIP switch 14, the desired one can be selected from among the two kinds of data maps, MAP 1, MAP 2 can be selected; and thus, for example, on the manufacture line or during the maintenance work after the shipping of products, a suitable data map for the FL display panel 1 is selected on the basis of the result of measuring the characteristic of the EL display panel 1, whereby the characteristic dispersion can be absorbed. As a result, the correction control against a shadowing phenomenon can be accurately executed even in case that the characteristic of the EL display panel 1 disperses from product to product; and thus, the deterioration of the display quality can be prevented. It is a matter of course that the system can be constituted in such a manner that three or more kinds of data maps are stored in the EEPROM 13.

In addition, since the EL display panel 1 is constituted in a simple matrix form, it becomes possible to perform many types of display, suppressing the occurrence of a shadowing phenomenon.

Further, the system is constituted in such a manner that the above-mentioned blank signal BLK is given to the data-side driver IC7, and the data-side driver IC7 is constituted in such a manner that the pulse width of the data voltage is controlled on the basis of the given blank signal BLK, whereby the pulse width of the composite voltage is determined; and thus, the following effects can be expected.

In case a high driving voltage is necessary as in case of the EL display panel 1, it is a commonly practiced measure to interpose a photo coupler for providing an electric isolation at the side of the scanning electrodes 2*a*, 2*b*. However, the photo coupler is poor in temperature characteristic, so that, in case of constitute the system in such a manner that the pulse width of the scanning voltage applied to the scanning electrodes 2*a*, 2*b* is controlled, the signal transfer delay time is increased due to the above-mentioned temperature characteristic of the photo coupler is increased, whereby it becomes difficult to control the scanning voltage to a desired pulse width; and therefore, it becomes impossible to execute correction control with a high accuracy against a shadowing phenomenon. In contrast, in case of the system is constituted so as to control the pulse width of the data voltage as mentioned above, the correction control against a shadowing phenomenon can be executed with high accuracy.

However, in cases such as, e.g., the case where the influence exerted by the above-mentioned signal transfer delay time is small or ignorable, such correction control as mentioned above can also be executed by controlling the pulse width of the scanning voltage or the hold time for holding the charged state of the picture elements 4 which function as capacitive elements.

The data maps MAP 1 MAP 2 are constituted in such a manner that the pulse width data are written into them so as to correspond, at the rate of 1 to 1, to the plurality of addresses corresponding to the count range of the up-counter 12, and therefore, the pulse width of the above-mentioned blank signal BLK determined by the counting result (the number of those picture elements which each assume a display state in response to one scan) of the up-counter 12 can be controlled with high accuracy, and at the same time, the characteristic which indicates the relationship between the number of the picture elements 4 which each assume a light-emitting state and the brightness (the application time of the composite voltage higher than the threshold voltage) of the light-emitting elements, can be set variously and minutely.

As mentioned above, in case of storing in the EEPROM 13 the two kinds of data maps MAP 1, MAP 2 (or in case of storing three or more kinds of data maps) which differ from each other in respect of the relationship of correspondence between the respective addresses and the pulse width data, optimum control can always be executed against a shadowing phenomenon by previously storing data maps suited to the respective driving conditions even in case that, for example, the driving condition (such as the driving frequency, the driving voltage or the like) for driving the EL display panel 1 is altered into a plurality of stages.

Since, in order to store the data maps MAP 1, MAP2, the system is constituted so as to utilize the EEPROM 13 which is a data rewritable non-volatile volatile memory, the maps can be written in at a predetermined stage. Due to this, even if the specifications of the EL display panel 1 are altered, or a characteristic change due to the deterioration with time takes place, it becomes possible to store the optimum data maps; and thus, eventually the fear that the correction control directed against a shadowing phenomenon may become inaccurate can be prevented from becoming true.

(Second Embodiment)

Figure 6:
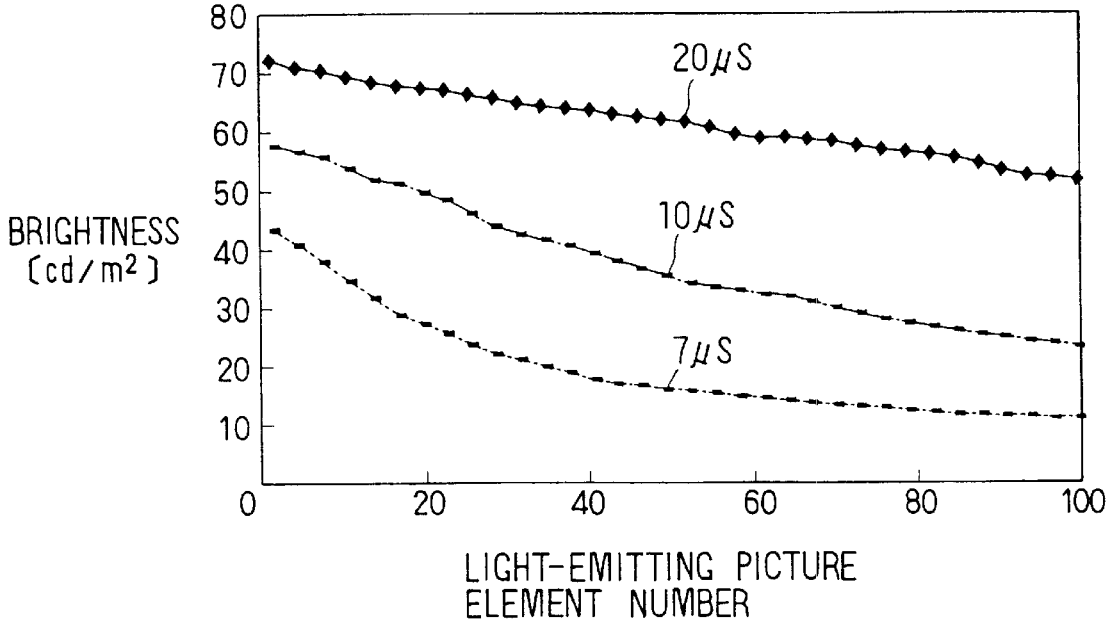
FIG. 6 is a characteristic graph showing the relationship between the light-emitting picture element number per scan and the brightness.
Figure 5:
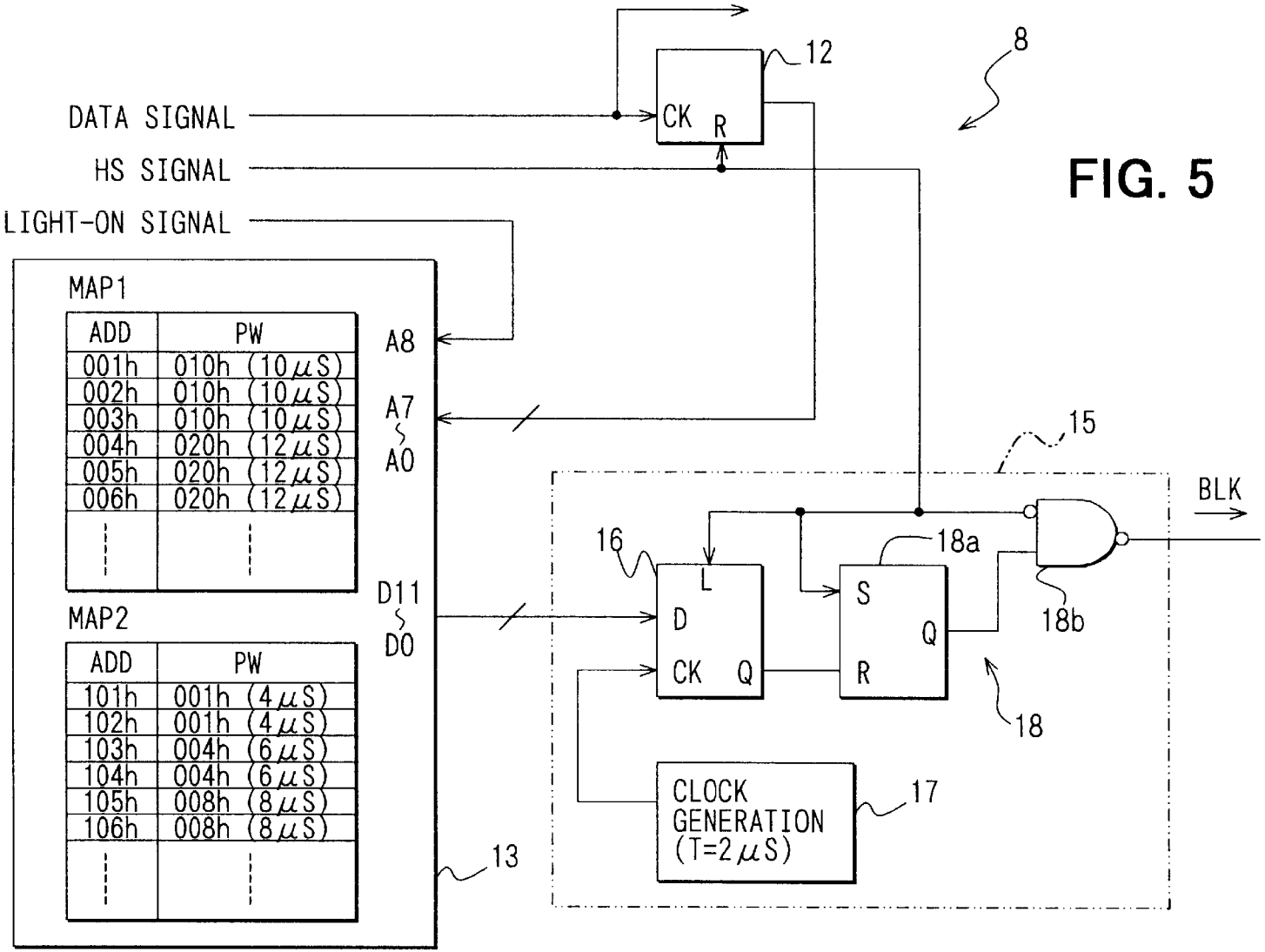
FIG. 5 is a diagram showing a second embodiment of the invention, this diagram corresponding to FIG. 1.

FIG. 5 and FIG. 6 show a second embodiment of the present invention, which will be described below concerning only that portion of Embodiment 2 which differs from Embodiment 1. This Embodiment 2 shown here is an example of the EL display panel 1 applied to a display device for a vehicle (such as a display and operation panel for the audio, a display and operation panel for the air conditioner, and a meter panel or the like).

Referring to FIG. 5, this embodiment shown is constituted in such a manner that, to the address terminal A8 of the EEPROM 13, a light-on signal from a lighting switch for, e.g., a vehicle is given as a high-order address-designating signal. The light-on signal can be also obtained from a light control system which automatically turns on the tail lamps and the headlamps in response to the brightness around the vehicle. In this case, in the EEPROM 13, the data map MAP 1 is selected in the state in which no light-on signal is inputted, while the data map MAP 2 is selected in the state in which a light-on signal is inputted.

The pulse width data written into the data maps MAP 1, MAP 2, respectively, are set in such a manner that the pulse width data at the data map MAP 1 side assume larger values on the whole than those at the data map MAP 2 side. In other words, the pulse width data in the data map MAP 1which is selected in the state in which no input-on signal is inputted (i.e., the state in which the outside area of the vehicle is bright) is set so as to be larger on the whole than the pulse width data in the data map MAP 2 selected in the state in which a light-on signal is inputted (i.e., the state in which the outside area of the vehicle is dark), whereby the light adjusting operation of lowering the brightness of the whole EL display panel 1 (See FIG. 3) in response to the inputting of the light-on signal, is executed.

If, in this case, the ratio between the pulse width data in the data map MAP 1 and the pulse width data in the MAP 2 are merely made to differ from each other, then problematic points as indicated below will arise. FIG. 6 shows the relationship between the number of the light-emitting picture elements 4 per scan of the EL display panel 1 and the brightness, using as a parameter the pulse width (in case of this embodiment, the pulse width of the data voltage) of the applied composite voltage higher than the threshold value.

As may be understood from this FIG. 6, in the state in which the pulse width of the applied composite voltage is relatively large, the relationship between the light-emitting picture element number and the brightness changes approximately linearly, but, in the state in which the above-mentioned pulse width is relatively small, the linearity of the relationship between the light-emitting picture element number and the brightness comes to be largely deformed. Thus, the pulse width data to be written into the data maps MAP 1, MAP 2 are set by taking such a characteristic into consideration. For example, the pulse width data written into the data map MAP 1 are set so as to increase approximately linearly in response to the increase in the count value of the up-counter 12 which indicates the number of the light-emitting picture elements per scan, while the pulse width data written into the data map MAP 1 are set so as to largely vary as the above-mentioned count value decreases.

According to this second embodiment, by selecting one of the two kinds of data maps MAP 1, MAP 2 which are set to states differing from each other on the whole, the light adjustment control of adjusting the brightness of the whole EL display panel 1 can be executed very easily. Further, the pulse width data written into the respective data maps MAP 1, MAP 2 are set by taking the "light-emitting picture element number/brightness" characteristic into consideration, so that, even in case that light adjustment control as mentioned above is executed to change the driving condition of the EL display panel 1, optimum control can be executed against the occurrence of a shadowing phenomenon.

(Third Embodiment)

Figure 7:
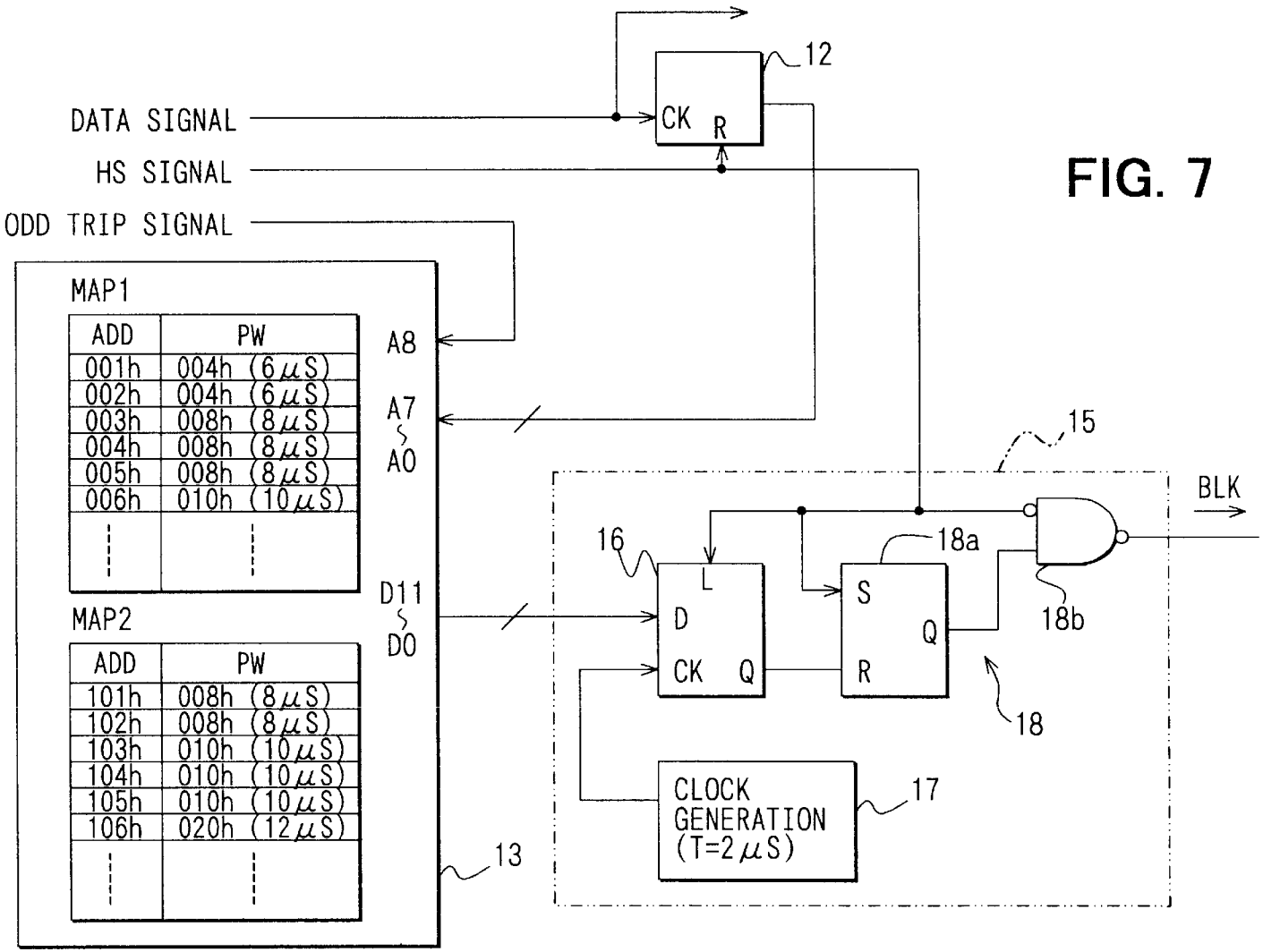
FIG. 7 is a diagram showing a third embodiment of the invention, this diagram corresponding to FIG. 1.

FIG. 7 shows a third embodiment of the invention, which will be described below with reference to only that portion of the third embodiment which differs from the first embodiment. This third embodiment also relates to an example of the system in which the EL display panel 1 is used for a vehicle display system, as in case of Second Embodiment.

In this embodiment shown in FIG. 7, there is provided a means for outputting an odd trip signal (corresponding to a signal indicating the degree of deterioration with time), and this odd trip signal is given as a high-order address-designating signal to the address terminal of EEPROM 13. In this case, in the EEPROM 13, the data map MAP 1 is selected in the state in which no odd trip signal is inputted, while, in the state in which an odd trip signal is inputted, the data map MAP 2 is selected.

In case of this embodiment, the pulse width data which are respectively written into the data maps MAP 1, MAP 2 are set in such a manner that the pulse data at the data map MAP 2 side assume values larger that the pulse width data at the data map MAP 1 side on the whole. In other words, the pulse width data in the data map MAP 2 which are selected in case that the mileage of the vehicle is relatively large (in case that the degree of deterioration proceed of the EL display panel 1 is relatively large) is set so as to become larger on the whole than the pulse width data in the data map MAP 1 selected in case the mileage of the vehicle is relatively small (in case that the deterioration progress degree of the EL display panel 1 is small).

Therefore, according to this embodiment, control is executed in such a manner that, in response to the progress of the deterioration with time of the EL display panel 1, the time for which the composite voltage higher than the above-mentioned threshold voltage is applied to the respective picture elements 4 becomes relatively long, and thus, the deterioration of the EL display panel 1 is compensated, so that it becomes possible to maintain the display quality in a good state over a long period.

In this embodiment, likewise, when the pulse data to be written into the data maps MAP 1, MAP 2 are set, the "light-emitting picture element number/brightness" characteristic shown in FIG. 6 is taken into consideration. Further, in this embodiment an add trip signal is used as the signal indicating the degree of deterioration with time of the EL display panel 1, but it is alternatively possible to provide a means for outputting a trigger signal in case the total driving time of the EL display panel 1 has exceeded a predetermined time, so that the trigger signal is utilized as the signal for indicating the degree f the deterioration with time of the EL display panel 1.

(Fourth Embodiment)

Figure 8:
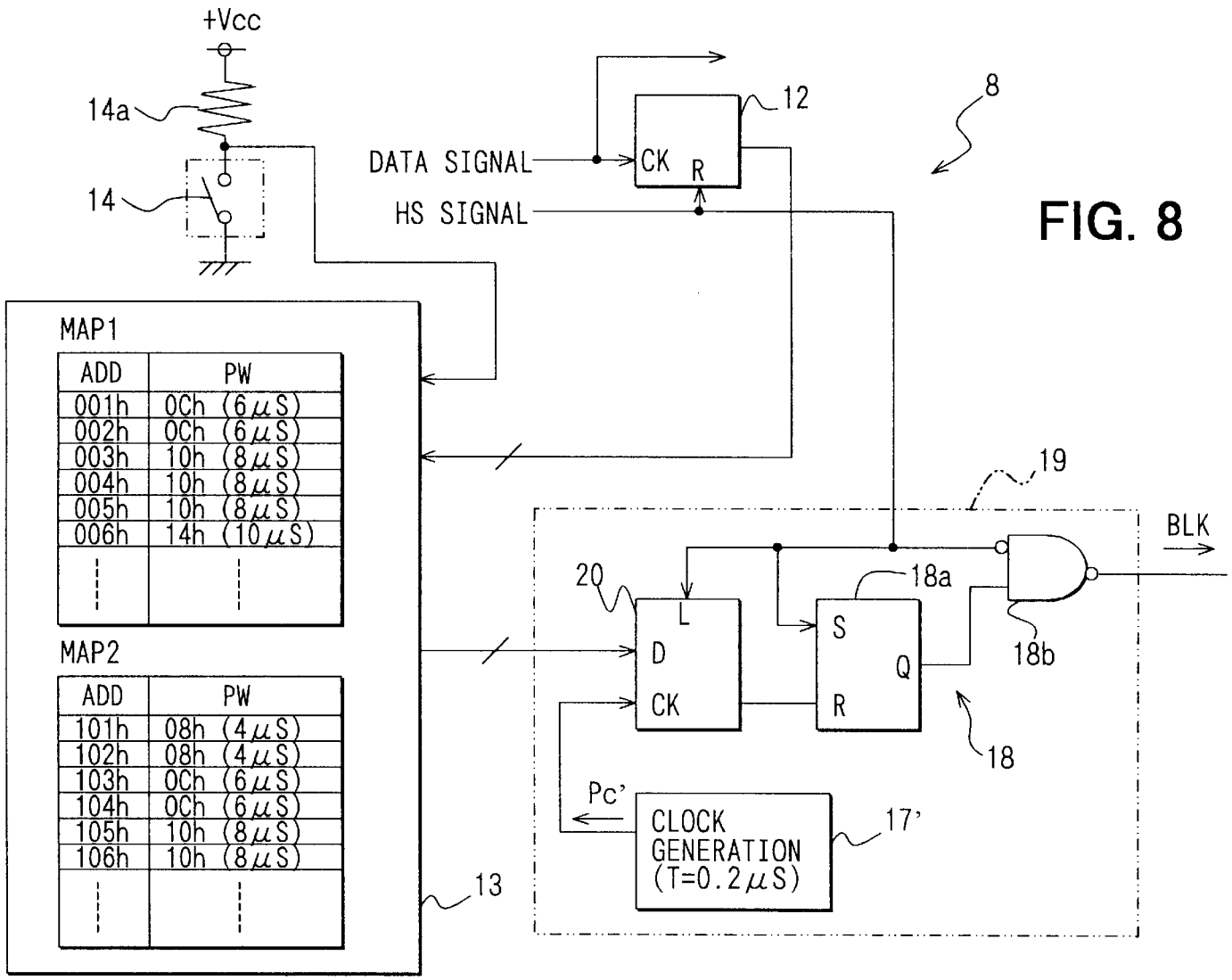
FIG. 8 is a diagram showing a fourth embodiment of the invention, this diagram corresponding to FIG. 1.

FIG. 8 shows a fourth embodiment of the invention which can achieve the same effect as the foregoing first embodiment; here, only the portion of this fourth embodiment which differs from the first embodiment will be described blow.

In case of this embodiment, the pulse width data written into the two kinds of data maps MAP 1, MAP 2 in the EEPROM 13 are not such data (that is, mono-pulse-like 12 bit data in which only one predetermined bit is "1", while the other bits become "0") as in the first embodiment, but the numerical value data (such as, e.g., 8 bits) indicating the pulse width itself are written.

The pulse width data addressed in the EEPROM 13 is given from the output terminals D0 to D7 thereof to a data terminal D of a down-counter 20 included in a signal generation means 19. This down-counter 20 receives at a clock terminal CK a clock pulse Pc (e.g., the cyclic period T=0.2 $\mu$S) from a clock generation circuit 17' and, at the same time, receives a horizontal synchronizing signal at a load terminal L; when the horizontal synchronizing signal has risen, the down-counter 20 is loaded with the pulse width data, that is, a numerical value data, from the EEPROM 13, counts down the thus loaded numerical value data in synchronism with the clock pulse Pc. Further, when the count value thereof has become "0", the down-counter 20 outputs a pulse-shaped carry signal from its output terminal Q; and, by this carry signal, an R-S flip-flop 18*a* in a signal processing circuit 18 is reset.

More specifically, in case the pulse width data outputted from the EEPRIOM 13 is, for example, "0 Ch", the down-counter 20 produces a carry signal at the timing (the timing at which 6 $\mu$S has elapsed after the rise of the horizontal synchronizing signal) at which 12 clock pulses Pc' have been inputted. Further, in case the above-mentioned pulse width data is "14h" for example, the down-counter produces a carry signal at the timing (the timing at which 10 $\mu$S has elapsed after the rise of the horizontal synchronizing signal) at which 20 clock pulses Pc' have been inputted.

In this case, the R-S flip-flop 18*a* is set in synchronism with the rise of the horizontal synchronizing signal to output a high-level signal from its output terminal Q and then reset at the timing at which the carry signal from the down-counter 20 rises to output a low-level signal from its output terminal Q; and the period during which the low-level signal is inverted to a high-level signal is controlled so as to become a time corresponding to the pulse width data outputted from the EEPROM 13. Then, from a NAND circuit 18*b*, a low-level blank signal BLK is outputted only during the period during which the horizontal synchronizing signal is in a low-level state and the output from the flip-flop 18*a* is inverted to a high-level signal.

(Fifth Embodiment)

FIG. 9 shows a fifth embodiment of the invention; this fifth embodiment will now be described below with reference to only the portion thereof which differs from the first embodiment.

This embodiment is constituted in such a manner that, into the respective addresses of the respective data maps MAP 1, MAP 2 in the EEPROM 13, the data (corresponding to the number of the light-emitting picture elements 4 per scan) indicating the count values in the predetermined 12 consecutive ranges of the up-counter 12 and the pulse width data associated with the above-mentioned count values data, are written. More specifically, in the embodiment shown in FIG. 9, into the address "001h" of the data map MAP 1, the count value data "02h" indicating that the count value of the up-counter 12 lies in "1" to "2" and the pulse width data "004h" associated with this are written; and, into the address "002h, the count value data "05h" indicating that the count value of the up-counter 12 lies in "3" to "5" and the pulse width data "008h" associated with the count value data "05h" are written.

In this embodiment, the pulse width data written into the data maps MAP 1, MAP 2 are mono-pulse-shaped 12-bit data, of which only one predetermined bit is "1", while the other bits are "0", but the system may alternatively be constituted in such a manner that, as in case of the foregoing fourth embodiment, the numerical value data indicating the pulse width itself is written. Further, in the data maps MAP 1, MAP 2 shown in FIG. 9, examples of the actual count values (corresponding to the light-emitting picture element number) are shown in a state written in parentheses and in a state associated with the respective count value data, and at the same time, examples of the actual application time are shown in a state written in parentheses and in a manner associated with the respective pulse width data.

Concerning the designated address in that data map of the data maps MAP 1, MAP 2 in the above-mentioned EEPROM 1 which is addressed in the same manner as in case of, e.g., First Embodiment, the pulse width data designated in accordance with the light-emitting picture element number per scan which number has been counted by the counter means is read out, and the signal processing based on this pulse width data is executed as in case of, e/g, First Embodiment, whereby the blank signal BLK is formed.

According to the fifth embodiment constituted as described above, it is sufficient to write the pulse width data associated with the count values in predetermined consecutive ranges of the up-counter 12 into the respective addresses of the data maps MAP 1, MAP 2 in the EEPROM 13, and therefore, it becomes possible to relatively decrease the data number and the memory capacity required of the EEPROM 13 can be reduced.

(Other Embodiment)

The present invention is not limited to the above-mentioned embodiments, but they can be modified or expanded as follows:

For example, in First Embodiment, a switching means for switching at least one of the magnitude of the driving voltage and the driving frequency for driving the EL display panel 1 into a plurality of stages by a hardware-like means, whereby the brightness of the whole EL panel 1 is made adjustable, and further, a plurality of kinds of data maps suited to the state switched by the above-mentioned switching means are stored in the EEPROM 13, so that, from among the plurality of data maps, the data map suited to the state switched by the switching means can be selected at the control circuit 8 side.

According to the above-mentioned constitution, by switching at least one of the driving frequency and the driving voltage to a plurality of stages, the brightness of the whole EL display panel 1 can be easily adjusted. In this case, since, from among a plurality of data maps, the data map suited to the state switched by the switching means can be selected; and thus, even in case the display state of the EL display panel 1 is switched, an optimum correction control can be always executed against a shadowing phenomenon.

The foregoing embodiments are each constituted in such a manner that data maps MAP 1, MAP 2 which store therein the pulse width data are provided, so that the data maps MAP 1, MAP 2 are utilized to adjust the pulse width of the composite voltage applied to the scanning electrodes 2*a*, 2*b* and the data electrode 3, whereby correction control is executed again a shadowing phenomenon, but the system can alternatively be constituted so as to execute the correction control by adjusting the magnitude of the composite voltage. In this case, data maps in which a plurality of addresses corresponding to the count ranges of the up-counter 12 and a plurality of stages of voltage value data indicating the magnitude of the composite voltage applied to the scanning electrodes 2*a*, 2*b* and the data electrode 3 are previously associated with each other, are stored. Further, a signal generation means is provided for generating a control signal for controlling the magnitude of the composite voltage actually applied to the scanning electrodes 2*a*, 2*b* and the data electrode 3 on the basis of the voltage value data read out from the above-mentioned data maps by the count resulting of the up-counter 12.

In case of storing the voltage value data in the data maps as mentioned above, a switching means is provided for switching into a plurality of stages at least one of the pulse width and the driving frequency of the driving voltage for driving the EL display panel 1, whereby the brightness of the whole EL display panel 1 is made adjustable, and in addition, a plurality of kinds of data maps suited to the state switched by the above-mentioned switching means are stored in the EEPROM 13, and; at the control circuit 8 side, the data map suited to the state switched by the switching means is selected from the above-mentioned plurality of data maps.

According to this constitution, by switching at least one of the driving frequency and the pulse width of the driving voltage into a plurality of stages, the brightness of the whole EL display panel 1 can easily adjusted. In this case, since the data map suited to the state switched by the switching means is selected from among the plurality of data maps, it is ensured that, even in case the display state of the EL display panel 1 is switched, optimum correction control can always be executed against a shadowing phenomenon.

In the respective foregoing embodiments, a data re-writable EEPROM is used as the memory means, but it is also possible to use a different data re-writable non-volatile memory such as EPROM. Further,the memory means need not necessarily be made data-rewritable, but it is also possible to use a non-volatile memory such as, e.g., a PROM. In case of using such a PROM, a plurality of data maps in which pulse width data or voltage values data are stored are previously written in the PROM, which is replaced when required.

According to this constitution, it is ensured that, even in case the characteristics are changed due to an alteration of the specifications of the display panel and the deterioration with time or even in case a dispersion in the characteristics is caused at the time of mass production, it is possible to easily cope with such inconvenience by replacing the PROM.

In the forgoing embodiments, a simple dot matrix type EL display panel 1 is the object to be driven, but it is also permissible to use the EL display panel at the segment side provided with scanning electrodes and data electrodes may be used as the object to be driven, and further, it is also possible to use a different type of EL display panel, a liquid crystal panel or a plasma display panel as the object to be driven.

What is claimed is:

1. A display panel driving system for driving a display panel including a display layer whose optical characteristic changes in response to the application of a voltage, and a plurality of scanning electrodes and a plurality of data electrodes disposed at both sides of the display layer, wherein, display elements are respectively formed in the regions in which the scanning electrodes and the data electrodes are opposed to each other, the display panel driving system comprising:

a scanning electrode driving circuit which produces a scanning voltage to be applied to the scanning electrodes;

a data electrode driving circuit which produces a data voltage to be applied to the data electrodes; and a control circuit which controls the operation of the scanning electrode driving circuit and the operation of the data electrode driving circuit, so that a composite voltage comprised of the scanning voltage and the data voltage is applied to the display panel by the sequential scanning method to turn the display elements into a display state, the control circuit including:

a counter means for counting the number of those display elements which are brought into a display state in response to the application of a voltage corresponding to one scan, a memory means in which data maps are stored, the data maps previously associating a plurality of addresses corresponding to counting ranges of the counter means and a plurality of stages of pulse width data indicating the pulse width of the composite voltage, and a signal generation means which generates a control signal for controlling the application time of the composite voltage so as to be brought into a state, in the data maps, corresponding to the pulse width data addressed by the counting result of the counter means wherein the pulse width data associated with count values of the counter means, several consecutive count values of which are defined in respective predetermined ranges, are written at the respective addresses in the data maps.

2. The display panel driving system according to claim 1, wherein:

the control signal is composed so as to be given to the data electrode driving circuit, and the data electrode driving circuit controls the pulse width of the data voltage on the basis of the given control signal to thereby determine the pulse width of the composite voltage.

3. The display panel driving system according to claim 1, wherein there are stored a plurality of data maps which differ from each other in respect of the relationship of correspondence between the respective addresses and the pulse width data in the memory means.

4. The display panel driving system according to claim 3, wherein:

there is provided a switching means which switches into a plurality of stages at least one of the magnitude and the driving frequency the driving voltage for driving the display panel, whereby the display state of the whole display panel can be adjusted, and the control circuit selects, from among the plurality of data maps, the data map suited to the state switched by the switching means.

5. The display panel driving system according to claim 3, wherein:

the memory means is constituted by storing a plurality of data maps in which the pulse width data are set into states differing from each other on the whole, and the control circuit adjusts the display state of the whole display panel by selecting from among the data maps.

6. The display panel driving system according to claim 3, wherein:

there are stored a plurality of data maps in which the pulse width data are set into states differing from each other on the whole in the memory means, and the control circuit is provided in such a manner that information indicating the degree of deterioration with time of the display panel is inputted to the control circuit, so that, as the deterioration with time of the display panel indicated by the information progresses, the control circuit selects, from among the plurality of data maps, the data map in which the pulse width data is large.

7. The display panel driving system according to claim 3, wherein there is provided an external switch for selecting from among the plurality of data maps.

8. The display panel driving system according to claim 1, wherein the memory means is comprised of a data re-writable non-volatile memory, and, at a predetermined stage, the data maps are written into thee memory means.

9. The display panel driving system according to claim 1, wherein the memory means is comprised of a non-volatile memory in which the data maps are previously written, the memory means being replaced as required.

10. The display panel driving system according to claim 1, wherein the display panel is constituted in a simple dot matrix form.

11. A display panel driving system for driving a display panel including a display layer whose optical characteristic changes in response to the application of a voltage, and a plurality of scanning electrodes and a plurality of data electrodes disposed at both sides of the display layer, wherein, display elements are respectively formed in the regions in which the scanning electrodes and the data electrodes are opposed to each other, the display panel driving system comprising:

a scanning electrode driving circuit which produces a scanning voltage to be applied to the scanning electrodes;

a data electrode driving circuit which produces a data voltage to be applied to the data electrodes; and a control circuit which controls the operation of the scanning electrode driving circuit and the operation of the data electrode driving circuit, so that a composite voltage comprised of the scanning voltage and the data voltage is applied to the display panel by the sequential scanning method to turn the display elements into a display state, the control circuit including:

a counter means for counting the number of those display elements which are brought into a display state in response to the application of a voltage corresponding to one scan, a memory means in which data maps are stored, the data maps previously associating a plurality of addresses corresponding to counting ranges of the counter means and a plurality of stages of pulse width data indicating the pulse width of the composite voltage, a shift register which converts, into a serial signal train synchronized with a clock signal, the pulse width data addressed, in the data maps, by the counting result of the counter means, and a signal processing circuit which generates a control signal, on the basis of the output from the shift register, for controlling the application time of the composite voltage so as to be brought into a state corresponding to the read pulse width data wherein the pulse width data associated with count values of the counter means, several consecutive count values of which are defined in respective predetermined ranges, are written at the respective addresses in the data maps.

12. A display panel driving system for driving a display panel including a display layer whose optical characteristic changes in response to the application of a voltage, and a plurality of scanning electrodes and a plurality of data electrodes disposed at both sides of the display layer, wherein, display elements are respectively formed in the regions in which the scanning electrodes and the data electrodes are opposed to each other, the display panel driving system comprising:

a scanning electrode driving circuit which produces a scanning voltage to be applied to the scanning electrodes;

a data electrode driving circuit which produces a data voltage to be applied to the data electrodes; and a control circuit which controls the operation of the scanning electrode driving circuit and the operation of the data electrode driving circuit, so that a composite voltage comprised of the scanning voltage and the data voltage is applied to the display panel by the sequential scanning method to turn the display elements into a display state, the control circuit including:

a counter means for counting the number of those display elements which are brought into a display state in response to the application of a voltage corresponding to one scan, a memory means in which data maps are stored, the data maps previously associating a plurality of addresses corresponding to counting ranges of the counter means and a plurality of stages of voltage value data indicating the magnitude of the composite voltage, and a signal generation means which generates a control signal for controlling the magnitude of the composite voltage so as to be brought into a state, in the data maps, corresponding to the voltage value data addressed by the counting result of the counter means wherein a magnitude of the composite voltage associated with count values of the counter means, several consecutive count values of which are defined in respective predetermined ranges, are written at the respective addresses in the data maps.

13. The display panel driving system according to claim 12, wherein:

the control signal is composed so as to be given to the data electrode driving circuit, and the data electrode driving circuit determines the magnitude of the composite voltage by controlling the level of the data voltage on the basis of the given control signal.

14. The display panel driving system according to claim 12, wherein the memory means is constituted so as to store therein a plurality of data maps which differ from each other in respect of the relationship of correspondence between the respective addresses and the voltage value data.

15. The display panel driving system according to claim 14, wherein:

there is provided a switching means which switches into a plurality of stages at least one of the pulse width and the driving frequency of the driving voltage for driving the display panel, whereby the display state of the whole display panel can be adjusted, and the control circuit selects from among the plurality of data maps a data map suited to the state switched by the switching means.

16. The display panel driving system according to claim 14, wherein the memory means is composed by storing therein a plurality of data maps in which the voltage value data are set into states differing from each other on the whole, and the control circuit adjusts the display state of the whole display panel by selecting from among the data maps.

17. The display panel driving system according to claim 14, wherein:

there are stored a plurality of data maps in which the voltage value data are set into states differing from each other on the whole in the memory means, and the control circuit is provided in such a manner that information indicating the degree of deterioration with time of the display panel is inputted to the control circuit, so that, as the deterioration with time indicated by the information progresses, the control circuit selects, from among the plurality of data maps, the data map in which the voltage value data is large.

18. The display panel driving system according to claim 14, wherein there is provided an external switch for performing selection from among the plurality of data maps.

19. A display panel driving system for driving a display panel including a display layer whose optical characteristic changes in response to the application of a voltage, and a plurality of scanning electrodes and a plurality of data electrodes disposed at both sides of the display layer, wherein, display elements are respectively formed in the regions in which the scanning electrodes and the data electrodes are opposed to each other, the display panel driving system comprising:

a scanning electrode driving circuit which produces a scanning voltage to be applied to the scanning electrodes;

a data electrode driving circuit which produces a data voltage to be applied to the data electrodes; and a control circuit which controls the operation of the scanning electrode driving circuit and the operation of the data electrode driving circuit, so that a composite voltage comprised of the scanning voltage and the data voltage is applied to the display panel by the sequential scanning method to turn the display elements into a display state, the control circuit including:

a counter means for counting the number of those display elements which are brought into a display state in response to the application of a voltage corresponding to one scan, a memory means in which data maps are stored, the data maps previously associating a plurality of addresses corresponding to counting ranges of the counter means and a plurality of stages of voltage value data indicating the magnitude of the composite voltage, a shift register which converts, into a serial signal train synchronized with a clock signal, the voltage value data addressed, in the data maps, by the counting result of the counter means, and a signal processing circuit which generates a control signal, on the basis of the output from the shift register, for controlling the magnitude of the composite voltage so as to be brought into a state corresponding to the read pulse width data wherein a magnitude of the composite voltage associated with count values of the counter means, several consecutive count values of which are defined in respective predetermined ranges, are written at the respective addresses in the data maps.

* * * * *